US006607078B2

(12) United States Patent
Pedroli et al.

(10) Patent No.: US 6,607,078 B2
(45) Date of Patent: Aug. 19, 2003

(54) SAMPLE PACKET LABEL AND RELATED METHOD OF MANUFACTURE

(75) Inventors: John L. Pedroli, Germantown, TN (US); Kenneth M. Dunkley, Germantown, TN (US)

(73) Assignee: CCL Label, Inc., Monrovia, CA (US)

( * ) Notice: Subject to any disclaimer, the term of this patent is extended or adjusted under 35 U.S.C. 154(b) by 0 days.

(21) Appl. No.: 09/835,607

(22) Filed: Apr. 16, 2001

(65) Prior Publication Data

US 2002/0148751 A1 Oct. 17, 2002

(51) Int. Cl.[7] ..... B65D 73/00; G09F 15/00

(52) U.S. Cl. ..... 206/462; 206/484; 206/806; 283/56

(58) Field of Search ..... 206/461, 462, 206/484, 806; 40/310, 311; 283/56, 94

(56) References Cited

U.S. PATENT DOCUMENTS 2,007,685 A * 7/1935 Lyle ..... 40/310
3,149,431 A * 9/1964 Blish ..... 40/311
4,824,143 A 4/1989 Grainger
4,982,838 A 1/1991 Fitjer
5,109,979 A 5/1992 Cole
5,161,688 A * 11/1992 Muchin ..... 206/484
5,568,866 A * 10/1996 Grosskopf et al. ..... 206/484
5,607,101 A * 3/1997 Saito ..... 206/462
5,667,863 A * 9/1997 Cullen et al. ..... 206/484
5,879,769 A * 3/1999 Greenland et al. ..... 206/461
5,918,608 A * 7/1999 Renna ..... 283/56

* cited by examiner

*Primary Examiner*—Bryon P. Gehman
(74) *Attorney, Agent, or Firm*—Warner Norcross & Judd LLP

(57) ABSTRACT

A label or neck hanger integrating a trial-use sample packet. The construction includes a first panel defining an aperture, a bubbled sample packet partially protruding through the aperture, and a base panel adhered to the top panel to sandwich the sample packet between the top and base panels. In the label embodiment, the base panel includes a pressure sensitive adhesive. In the neck hanger embodiment, the top panel includes a second aperture that fits around the neck of a bottle.

27 Claims, 5 Drawing Sheets

SAMPLE PACKET LABEL AND RELATED METHOD OF MANUFACTURE

BACKGROUND

The present invention relates to labels, and more particularly to labels including trial-use sample packets.

Currently, certain products are provided in small promotional or demonstration units sometimes referred to as single-dose or trial-use sample packets. Sample packets typically include a base panel and/or transparent panel overlying and secured to the base panel to form a "bubble" in which products are contained. Products suitable for packaging in the packets include materials in liquid, paste or powder form, such as food stuffs, personal care products, paints, pharmaceuticals, fragrances and the like.

Presently, manufacturers, distributors and retailers distribute trial-use sample packets through several channels. The packets are (1) distributed to potential customers through the mail, as sample or promotional material, (2) included in the packaging of related or complimentary products, or (3) used by demonstrators in department stores, for example, to demonstrate to potential customers the use of a particular product.

Although the prior art trial-use sample packets and distribution channels offer a way to promote various products, opportunity exists for significant success with any new trial-use sample packet or means for distributing the same in a novel manner.

SUMMARY OF THE INVENTION

The aforementioned problems are overcome in the present invention wherein a trial-use sample packet is incorporated into a product labeling device, such as a label or a neck hanger. In the present invention, the product labeling device includes a base panel, a "bubble" sample packet—including a margin portion surrounding the bubble and product in the bubble—and a top panel including an aperture. The sample packet margin portion is sandwiched between the top panel and the base panel and the bubble portion of the sample extends through the aperture.

When the labeling device is a label, the base panel includes a pressure sensitive adhesive to adhere the label to a product container or package. When the labeling device is a neck hanger, the top panel is divided into a tag portion and a body portion. The tag portion includes a hole for receiving the neck of the container, such as a bottle. The body portion includes the sample packet sandwiched between the top panel and a base panel as explained above. Sample packet hangers are fitted around the neck of a bottle containing products, preferably those related or complimentary to the sample.

The invention also includes a method for manufacturing labeling devices including trial-use sample packets. In this method, a top panel defining a hole is provided. A bubbled sample packet is placed against the top panel so the bubble extends through the hole and the rest of the packet, that is, the margin, abuts the top panel. A base panel is adhered over the top panel and the margin is sandwiched therebetween.

When the labeling device is a label, the base panel preferably is pressure sensitive label stock. When the labeling device is a neck hanger, at least two holes are cut in the top panel—one hole in the tag portion to receive a container neck and a second hole in the body portion. The cut portions are removed. A bubbled sample packet is placed against the top panel so the bubble extends through the second hole and the margin abuts the top panel. A base panel is adhered over the top panel to sandwich the margin therebetween.

The trial-use sample packet labels and neck hangers of the present invention offer a significant advantage. In label or neck hanger form, sample packets for certain products are easily affixed to related or complimentary products. For example, a sample packet label including a hair conditioner can be affixed to a container of shampoo. Likewise, a sample packet neck hanger including hair conditioner can be secured around the neck of a bottle of shampoo. By associating trial-use samples with complimentary or related products via the present invention, manufacturers, distributors and retailers samples can more effectively target potential consumers.

These and other objects, advantages and features of the invention will be more readily understood and appreciated by reference to the detailed description of the preferred embodiments and the drawings.

DETAILED DESCRIPTION OF THE PREFERRED EMBODIMENTS

Figure 1:
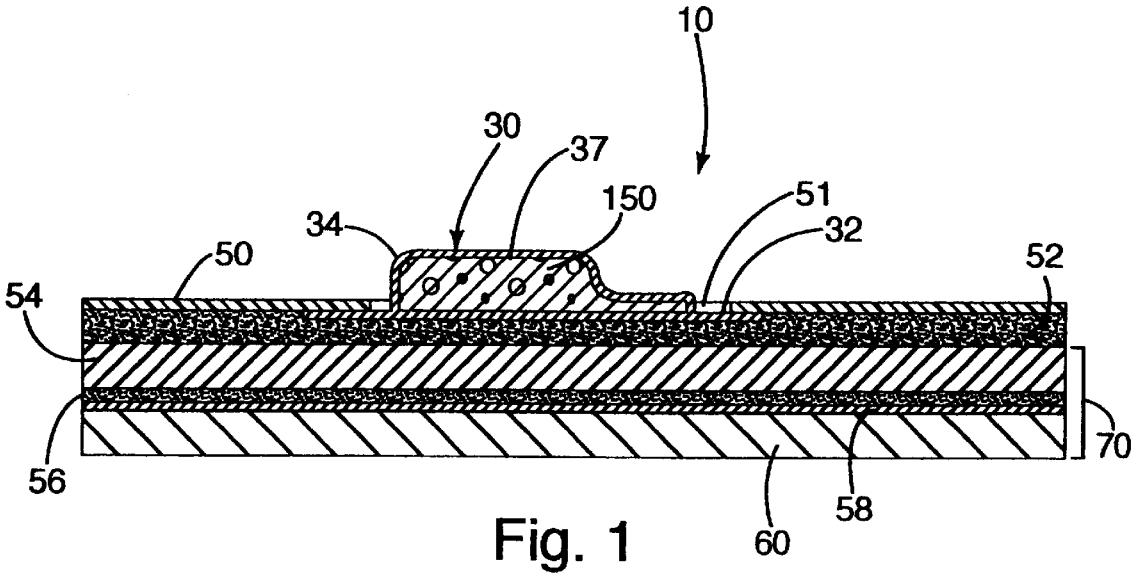
FIG. 1 is a section view of a sample packet label of the present invention.

The preferred sample packet construction of the present invention will be described in connection with a sample packet label 10 depicted in FIGS. 1–4. The sample packet label generally includes top panel 50, sample packet 30 including bubble portion 34 which protrudes through aperture 51 defined by top panel 50, base panel 54, and adhesive layer 56 which adheres the sample packet label to an article, such as the container depicted in FIG. 4.

Figure 3:
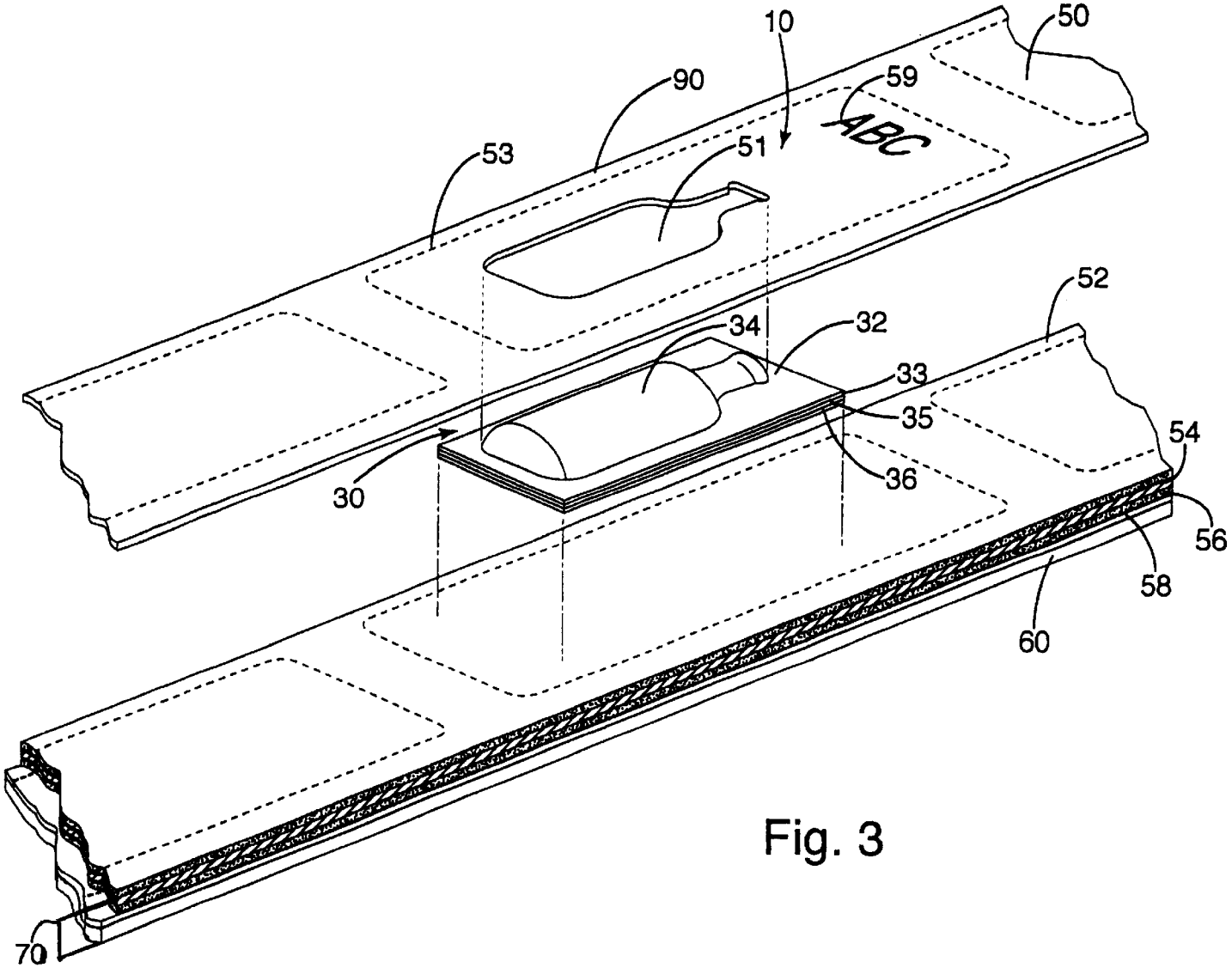
FIG. 3 is an exploded perspective view of the sample packet label.
Figure 4:
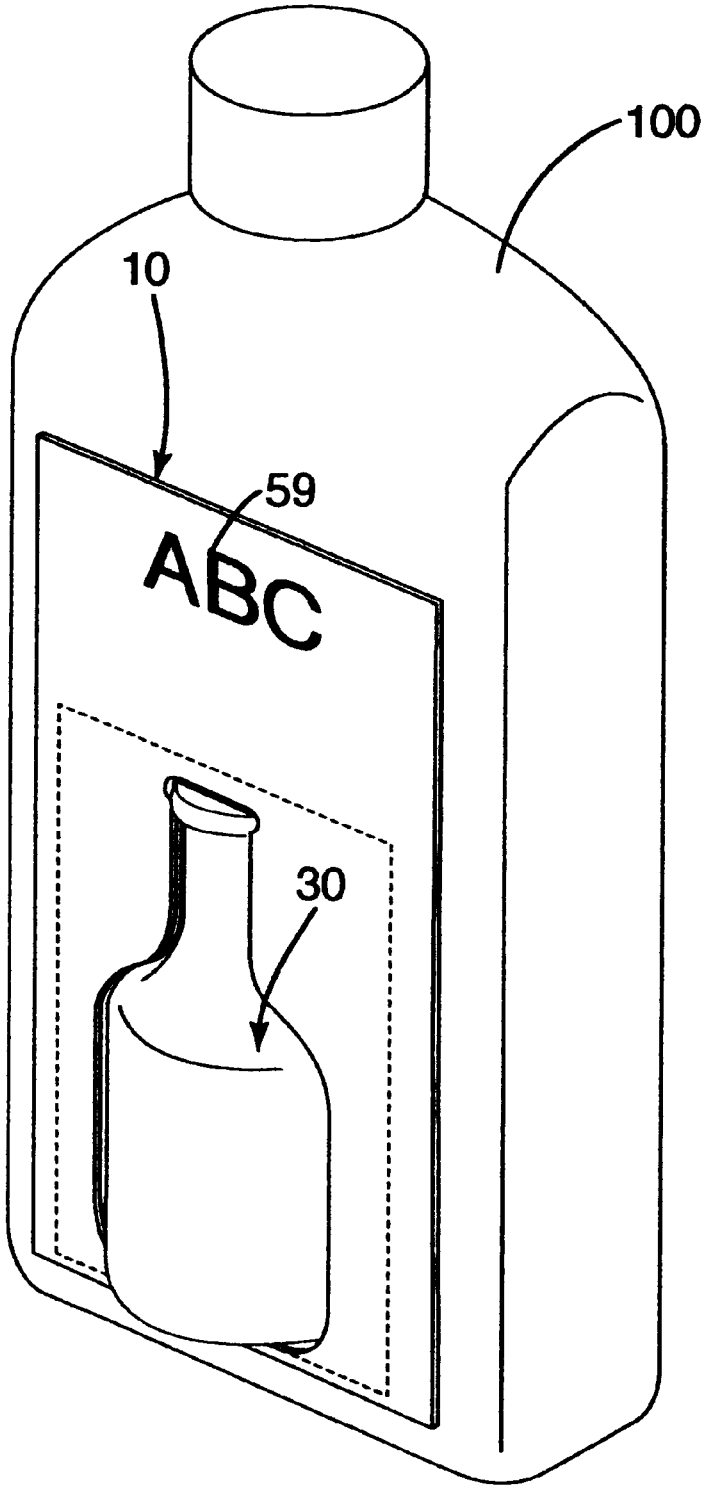
FIG. 4 is a perspective view of a sample packet label disposed on an article.

With particular reference to FIGS. 1 and 3, the top panel 50 defines aperture 51. Top panel 50 may be constructed of any material such as paper, foil, or plastic, or any layered combination of these materials. As desired, the top panel may have indicia such as text or graphics 59 printed on it. The aperture 51 defined by top panel is of sufficient size and dimension to allow bubble portion 34 of sample packet 30 extend through it.

The sample packet 30, depicted in FIGS. 1 and 3, includes first leaf 33 and second leaf 36 secured together in an opposing manner to form a compartment 37, in which product to be sampled 150 is contained, surrounded by margin or flange portion 32. The leaves 33 and 36 are preferably plastic or polymeric, but may also be constructed of paper or foil, or any combination of these materials. As will be appreciated, the leaves may be fused, fastened, adhered or secured together in any manner. Optionally, the sample packet may be constructed of a single piece of material (not shown) specifically molded to form a compartment and margin portion similar to that formed by the adjoined leaves 33 and 36.

The compartment 150 preferably is sealed air tight, but for larger sized particulate material, it need not be. The compartment may contain any powder, paste, or liquid material depending on the desired sampling or trial-use application. As depicted, the sample packet includes a single compartment 37, however, as desired, the sample packet may include any number of compartments, and each may contain the same or different sample materials 150.

Margin 32 surrounds the compartment 37 that forms a bubble-like portion 34 that protrudes from the sample packet 30. The margin portion may alternatively surround a preselected portion of the compartment. Preferably, the margin is dimensioned and sized so that it is larger than the aperture 51 through which the bubble 34 protrudes.

With further reference to FIGS. 1 and 3, margin 32 of the sample packet 30 is sandwiched between the top panel 50 and the base panel 54. The top panel 50 is adhered with adhesive 52 to the label stock 70, which includes base panel 54, adhesive 56, coating 58 and release liner 60, as desired. Preferably, the adhesives 52 and 56 are pressure sensitive, but any combination of pressure sensitive adhesive, permanent adhesive and hot glue may be used. The base panel 54 is preferably constructed of paper stock, but may also be of plastic, foil, or any combination of these materials.

In the preferred embodiment, adhesive 56 secures base panel 54 to a release liner 60. To facilitate removal of the base panel 54 from the release liner 60, the liner is coated with a silicone or release coating 58. Optionally, the coating 58 may be absent for certain applications.

Figure 2:
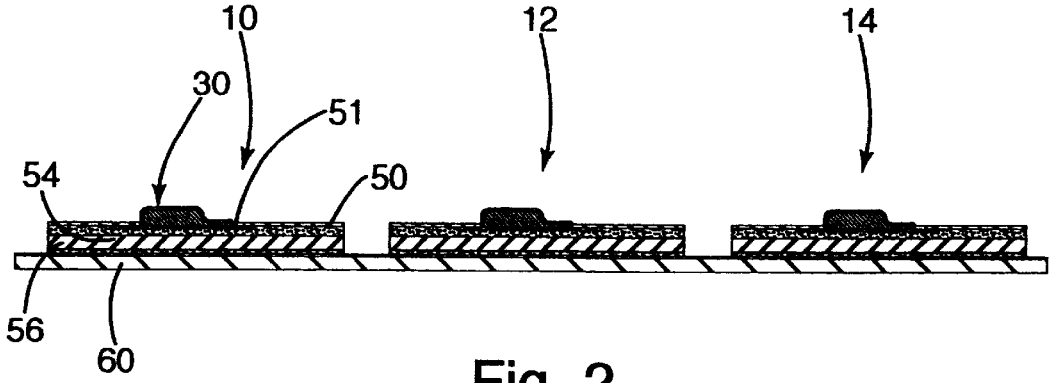
FIG. 2 is a section view of multiple sample packet labels on a carrier web.

As depicted in FIG. 2, continuous web release liner 60 carries the individual labels 10, 12, and 14. The carrier web release liner 60 may be wound into a roll or fan folded, where one label is folded over the next.

Method of Manufacture

The preferred process for manufacturing the trial-use sample packet labels will now be described with reference to FIG. 3. In general, the process includes the steps: providing a top layer including at least one hole through it; positioning a sample packet that includes a bubble portion against the top layer so that the bubble portion extends through the hole defined by the top layer; and securing a base layer to the top layer over the sample packet to sandwich the sample packet between the base layer and the top layer.

In a preferred process, a continuous web of paper stock top panel 50 is printed on a first side with information 59. Conventional equipment such as a die cutter or laser (not shown) cuts a hole 51 in the top panel and waste (not shown) is removed from the hole 51. Next, the bubble portion 34 of the sample packet 30 is positioned though the hole 51 defined by the top panel. The sample packet 30 is preferably supplied in pre-assembled form with materials contained in it. Notably, the bubble portion 34 may extend "through" the hole 51 even though it does not protrude above the top surface of the top panel 50.

In another step, label stock 70 is brought against the top panel web 50 so that adhesive 52 secures the two together. Consequently, the sample packet 30 is sandwiched between the top layer 50 and the label stock 70 including base panel 54. In particular, most of the margin portion 32 abuts the top panel 50 in the area surrounding the aperture 51. Some of the margin portion 32 adjacent the bubble portion 34 does not abut the top panel 50 and is visible through the aperture 51. The amount of margin 32 abutted against the top panel 50 and the amount of visible margin 32 may be varied as desired.

Once the label stock 70 is secured to the top panel 50, individual labels 10 may be cut from the web using any conventional cutting equipment, such as die-cutters or laser cutters. Preferably, the cutting occurs after the label stock 70 is adhered to the top panel 50 to ensure proper alignment of cuts in both materials. As depicted in FIG. 3, the labels 10 are skeleton cut, that is, the outer peripheries of individual labels 10 are cut along cut lines 53 so that those peripheries do not correspond to the edges of the top panel 50. Accordingly, a waste matrix 90 is created. This waste matrix 90 is separated from the release liner and collected.

In an alternative embodiment, rather than die cutting the individual labels from the web and creating a waste matrix, the labels are butt cut, that is, straight cut from the web whereby each completed label is immediately adjacent to other labels and there is no waste material.

Once the labels are cut and individually formed on the release liner web 60, the release liner may be wound into a roll or fan folded to facilitate distribution of the labels and/or later application of the labels onto articles. As desired, the labels may be directly applied to product containers or packaging, or packaged for shipment to end-users after cutting.

Alternative Embodiment

Figure 5:
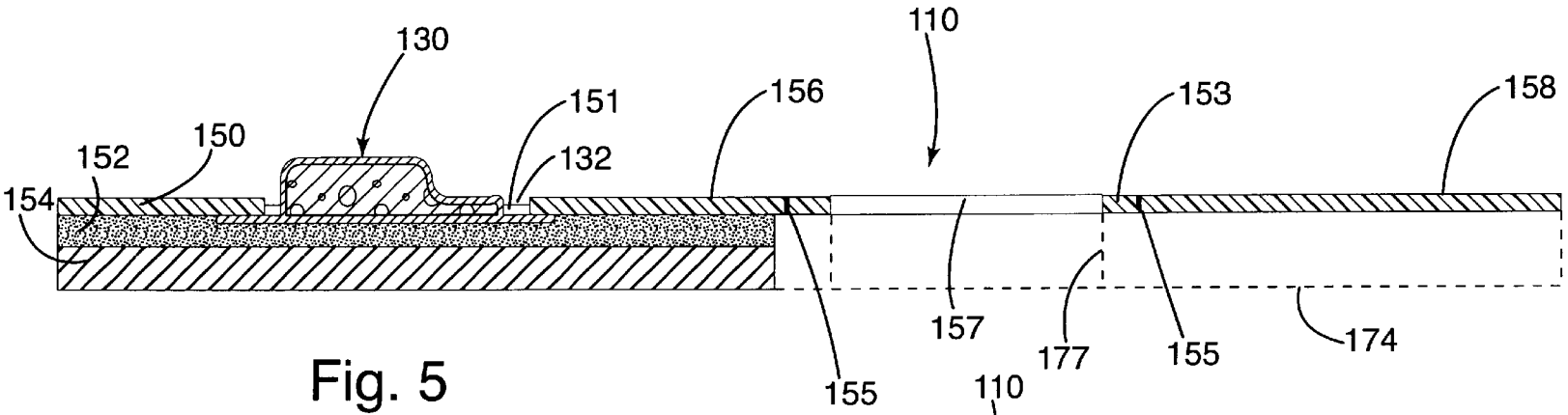
FIG. 5 is a section view of a sample packet neck hanger of the present invention.
Figure 6:
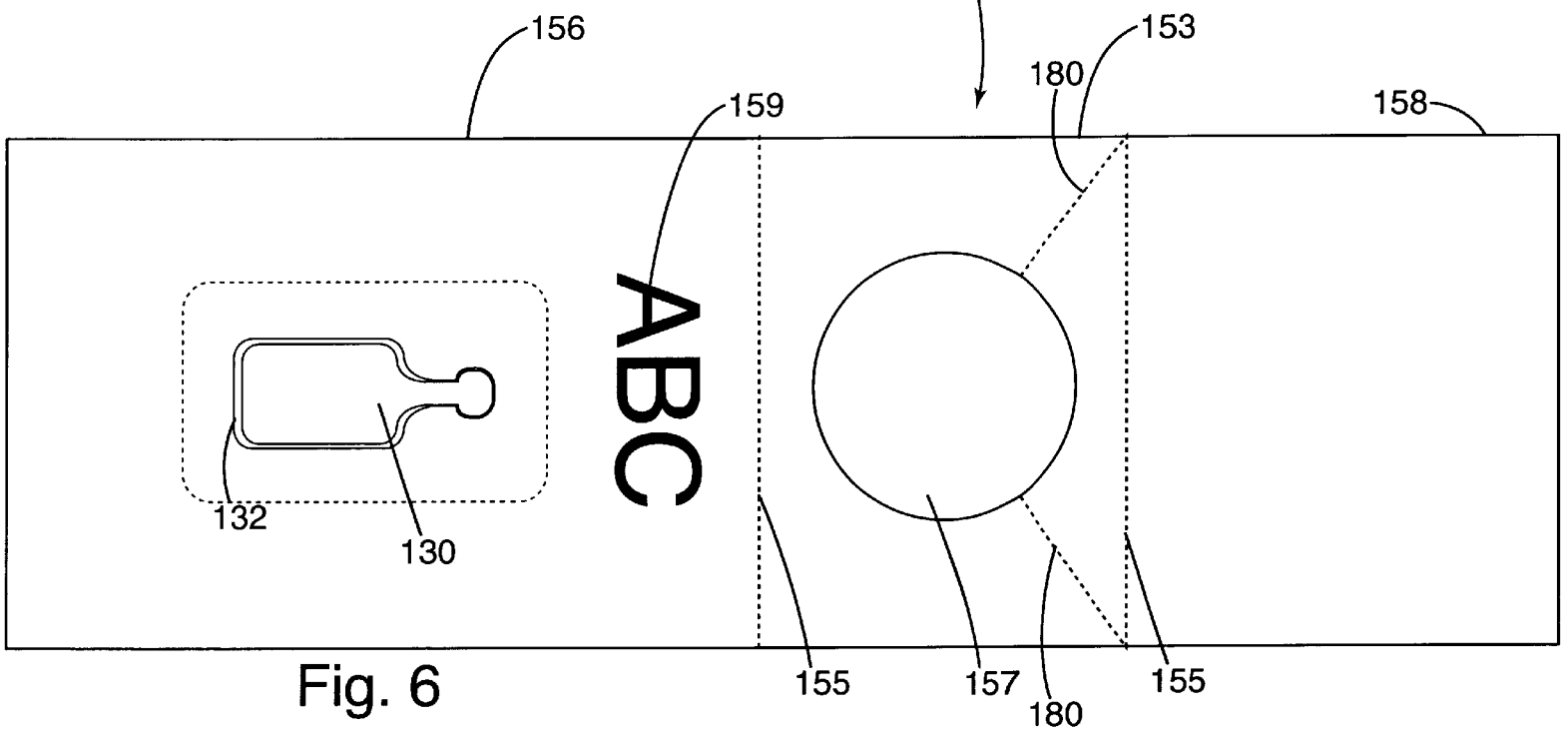
FIG. 6 is a top plan view of a sample packet neck hanger.
Figure 7:
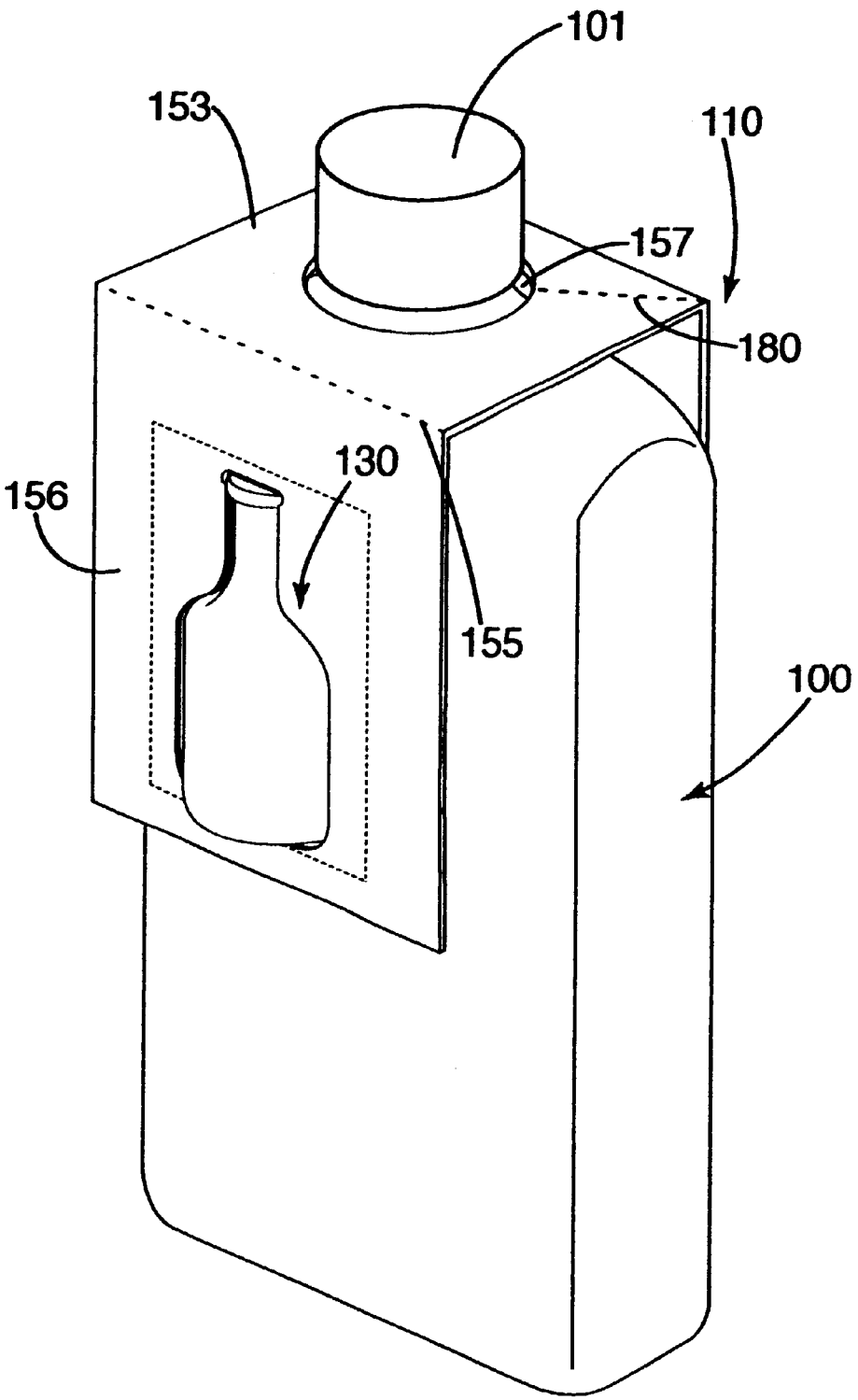
FIG. 7 is a perspective view of a sample packet neck hanger on an article.

In an alternative embodiment, generally depicted in FIGS. 5–7, a sample packet is incorporated into a neck hanger. The sample packet neck hanger 110 defines aperture 157 through which neck 101 of bottle 100 fits. The sample packet 130 is mounted to a body portion 156 of the hanger 110. Perforations 180 facilitate removal of the hanger from the necked article.

With reference to FIGS. 5 and 6, the sample packet neck hanger 110 is of a multi-layer construction that includes a top panel 150 defining apertures 151 and 157, a sample packet 130 including a bubble portion that protrudes through the aperture 151, and a base panel that sandwiches the sample packet 130 against the top panel 150.

As depicted in FIGS. 5 and 6, folding perforations 155 intermittently and transversely penetrate portions of top panel 150 to separate the tag portion 153 from the body portions 156 and 158 of which body portion 156 carries the sample packet 130. Hole 157 is defined by the inner portion of the tag portion 153. A set of tear lines 180 traverse the hanger from hole 157 and intermittently penetrate portions of the top panel 150 to the outer boundary of the individual hanger 110.

The top panel 150 also defines an aperture 151 through which bubble portion of the sample packet 130 protrudes. The aperture may be of any size or dimension to allow the sample packet to protrude through it.

Optionally, the top panel 150 may include multiple apertures so that multiple sample packets may be incorporated into a single body portion or a single neck hanger (not shown). A second sample packet also may be included in body portion 156. Optionally, body portion 158 may be absent from the sample packet neck hanger as desired.

The top panel 150 of the neck hanger depicted in FIGS. 5 and 6 includes a single layer; however, the panel may be of any multi-layer construction and include, for example, overlaminate layers and print layers (not shown). Top panel 150 may be constructed of any material such as paper, foil, or plastic, or any layered combination of these materials.

The base panel 154 secures to the top panel with adhesive 152, which is preferable pressure sensitive, but optionally may be a permanent adhesive or hot glue. The base panel 154 sandwiches margin 132 of the sample packet 130 between itself and the top panel 150. The base panel 154 is preferably paper stock, but may also be plastic, foil, or any combination of these materials. The base panel 154 may include information layers (not shown) on the visible underside of the neck hanger.

Optionally, the base panel may be of the same size and dimension of the top panel. Referring to FIG. 5, a base panel extension 174 (shown in broken lines) makes the base panel 154 the same size as the top panel 150, and further defines a base panel aperture 177 (shown in broken lines). The base panel aperture 177 is preferably aligned with the aperture 157 when the base panel 154 is secured to the top panel 150. As will be appreciated, if the base panel and top panel are simultaneously cut to form a hole for the neck of a bottle, the subsequent holes in both the base panel and the top panel, 157 and 177, respectively, will consequently be aligned.

The sample packet 130 of the sample packet neck hanger 110 is the same as that above relating to the sample packet label of the preferred embodiment.

The process for manufacturing the trial use sample packet neck hanger of FIGS. 5 and 6 will now be described. In general, the process includes the steps: providing a material including a first hole in the material to receive the neck of a container and a second hole in the material; and securing a sample packet including a bubble portion and a margin portion against the material so that the bubble portion extends at least partially through the second hole defined by said material.

In a particular process for manufacturing a trial use sample neck hanger, a paper stock top panel 150 is printed on one or both sides with information 159. Conventional equipment such as a die cutter or laser (not shown) cuts at least two holes 151, 157 in the top panel 150; and waste (not shown) is removed from the holes. The bubble portion 34 of the sample packet 130 is disposed though the hole 151 defined by the top panel. Notably, the bubble portion may extend "through" the hole even though its structure does not protrude above the top surface of the top panel 150. The sample packet 130 is preferably supplied in pre-assembled form with materials or product contained in it.

In another step, base panel 154 is brought against the top panel 150 so that adhesive 152 secures the two together. Consequently, the sample packet 130 is sandwiched between the top panel 150 and the base panel 154. In particular, most of the margin portion 132 abuts the top panel 150 in the area surrounding the aperture 151. Some of the margin portion 132 adjacent the bubble 134 does not abut the top panel 150 and is visible through the aperture 151 (FIG. 6). The amount of margin 132 abutted against the top panel 150 and the amount of visible margin 132 may be varied as desired.

The top panel 150 is cut a second time to define transverse perforations or fold lines 155 and optional sets of tear lines 180. Optionally, the above manufacture of sample packet neck hangers may be carried out in continuous web form, with the top panel forming the web. All of the above steps are carried out, but in addition, individual sample packet neck hangers are cut from the web using any conventional cutting equipment, such as die-cutters or laser cutters. The individual sample packet neck hangers may be cut using conventional butt-cutting methods or peripheral/skeleton cutting methods, as described above.

Completed individual sample packet hanger 110 is transported to a station for application of the individual hangers to the necks of bottles or similarly necked articles (FIG. 7). Optionally, multiple sample packet neck hangers 110 are packaged and shipped to end-users.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A sample packet label comprising:

a first layer defining an aperture;

a sample packet including a bubble container portion that defines an internal, substantially sealed compartment and a margin adjacent said container portion; and a second layer secured to said first layer, said margin sandwiched between said first layer and said second layer, said container portion protrudes above said aperture defined by said first layer, said second layer including an adhesive enabling the sample packet label to be adhered to articles.

2. The sample packet label of claim 1 wherein said bubble portion contains a material chosen from a liquid, a paste and a powder.

3. The sample packet label of claim 2 wherein said sample packet includes a plurality of compartments to contain said materials.

4. The sample packet label of claim 3 wherein said sample packet is constructed from materials chosen from polymers, foil and paper.

5. The sample packet label of claim 4 wherein a plurality of sample packet labels are carried on a web.

6. The sample packet label of claim 5 wherein said plurality of sample packet labels are formed on the web by cutting according to a method chosen from butt cutting and skeleton cutting.

7. A sample packet neck hanger comprising:

a first panel defining a first aperture adapted to receive the neck of a container and a second aperture;

a sample packet including a front portion and a rear portion forming a bubble portion, extending through said second aperture and above said first panel, said packet including a margin portion extending away from said bubble portion; and a second panel secured to said first panel, said rear portion secured to said second panel.

8. The sample packet neck hanger of claim 7 wherein said first panel includes a tag portion and a body portion, and wherein said first aperture is defined by said tag portion and said second aperture is defined by said body portion.

9. The sample packet neck hanger of claim 8 further comprising perforations which define a boundary between said tag portion and said body portion, and which facilitate removal of said body portion from said tag portion.

10. The sample packet neck hanger of claim 9 wherein said sample packet includes a plurality of compartments for containing materials.

11. A trial use sample construction comprising:

a first panel defining an aperture;

an envelope including a front leaf and a rear leaf sealed together to define at least one sealed chamber; and a second panel coupled to said first panel, said envelope sandwiched between said first panel and said second panel, said rear leaf adhered to said second panel with an adhesive, at least a portion of said sealed chamber extending through said aperture.

12. A method for constructing a neck hanger comprising the steps of:

providing a material defining a first hole to receive the neck of a container and a second hole;

securing a sample packet, including a bubble portion having a first portion and a second portion joined to define a sealed compartment against the material so that said bubble portion extends at least partially through the second hole, and adhering a panel over the second portion.

13. The method of claim 12 comprising the step of securing a panel to the material and the sample packet, said sample packet including a margin portion, so that the margin portion is sandwiched between the panel and the material.

14. The method of claim 13 comprising the step of repeating all of said steps to manufacture a plurality of neck hangers.

15. The method of claim 14 wherein said plurality of neck hangers is manufactured in continuous web form.

16. The method of claim 15 wherein said plurality of neck hangers is separated from the continuous web form by butt cutting the individual hangers from the web.

17. The method of claim 15 wherein said plurality of neck hangers is separated from the continuous web form by die cutting the hangers from the web and further producing a waste matrix.

18. A neck hanger manufactured by the process of claim 12.

19. A method for constructing a label comprising the steps of:

providing a top layer defining a hole;

positioning a sample packet that includes a bubble portion that defines a substantially sealed compartment and a margin portion against the top layer so that said bubble portion extends through the hole defined by said top layer and protrudes above said top layer; and securing a base layer to the top layer over the sample packet whereby the margin portion is sandwiched between said base layer and said top layer wherein the base layer includes an adhesive capable of securing the base layer to an article.

20. The method of claim 19 comprising the step of repeating all of said steps to manufacture a plurality of labels.

21. The method of claim 20 wherein said plurality of labels is manufactured in continuous web form.

22. The method of claim 21 comprising the step of serially applying the labels to articles.

23. The method of claim 22 wherein said adhesive is a pressure sensitive adhesive.

24. The method of claim 23 wherein said continuous web is a release liner.

25. The method of claim 21 wherein said plurality of labels is separated from the continuous web form by butt cutting the individual labels from the web.

26. The method of claim 21 wherein said plurality of labels is separated from the continuous web form by die cutting the labels from the web and further producing a waste matrix.

27. A label manufactured by the process of claim 19.

* * * * *